United States Patent [19]

Flatt et al.

[11] 4,008,943

[45] Feb. 22, 1977

[54] HIGH VOLTAGE CABLE TERMINATOR HAVING A FAULT ACTUATED PROBE

[75] Inventors: Richard P. Flatt, Oconomowoc; Edwin A. Link, Waukesha, both of Wis.

[73] Assignee: RTE Corporation, Waukesha, Wis.

[22] Filed: July 17, 1975

[21] Appl. No.: 596,767

[52] U.S. Cl. ..... 339/111; 200/51.1; 200/144 C; 339/117 R; 339/143 R

[51] Int. Cl.[2] ..... H01R 13/52

[58] Field of Search ..... 339/111, 60 R, 60 C, 339/61 R, 94 R, 117 R, 143 R; 200/51.1, 144 C, 147 R, 148 A, 149 A

[56] References Cited

UNITED STATES PATENTS 3,884,542 5/1975 Flatt ..... 339/111

*Primary Examiner*—W. Tupman
*Assistant Examiner*—DeWalden W. Jones
*Attorney, Agent, or Firm*—Ronald E. Barry

[57] ABSTRACT

A quick-make, quick-break probe contact assembly for connecting a high voltage cable to a high voltage bushing, the probe contact assembly being mounted in a cable terminator and including a movable section responsive to either an arc-generated arc-extinguishing gas, or to a fuse generated gas pressure for accelerating close-in with the bushing under fault current conditions. The probe contact assembly can also include a spring biased snap release sleeve that is retained within the bushing on load break of the cable terminator from the bushing to accelerate arc-out.

26 Claims, 11 Drawing Figures

HIGH VOLTAGE CABLE TERMINATOR HAVING A FAULT ACTUATED PROBE

BACKGROUND OF THE INVENTION

In a high voltage terminator assembly of the type shown in U.S. Pat. No. 3,474,386, issued on Oct. 21, 1959 and entitled "Electrical Connector", arc-quenching materials were provided on the ends of the probe contact and bore contact. These materials were located to produce an arc-generated, arc quenching gas on close-in and load break of the terminator with a bushing. Under normal conditions, the arc-extinguishing gases produced by the prestrike arc or the load break arc, are not sufficient to produce a hazardous condition. However, these gases are confined within the bushing and under fault current conditions the gas pressure increases rapidly producing an explosive condition within the bushing. In order to reduce the amount of gas pressure created on close-in and load-break under fault current conditions, a bushing was designed and described in E. J. Kotski U.S. Pat. No. 3,542,986 which issued on Nov. 24, 1970 and is entitled "Quick-Make, Quick-Break Actuator for High Voltage Electrical Contacts". However, this bushing is specially designed and requires replacement of the entire bushing presently being used.

SUMMARY OF THE INVENTION

The high voltage quick-make probe contact assembly of the present invention provides for accelerated movement of a movable section on the probe contact under fault current conditions in order to rapidly extinguish the arc on both close-in and load-break. This movement is produced either from the gas pressure of the gases formed by the heat of the arc on closing, or by the gases produced upon fusing of a fusible section provided within the probe contact assembly. This rapid or accelerated movement of the probe contact into electrical engagement with the bushing reduces the time interval of the arc and thus increases the life of both the rod and bore contacts. Arc-out can generally be expected within one-half cycle.

The probe contact assembly according to the invention is provided with a movable section which can be rapidly moved into engagement with the bore contact in the bushing by gas pressure. In one form of the invention, the movable section is provided with a lost motion connection so that it can be snap released from the bore contact on load break with sufficient speed to rapidly extend and extinguish the arc in order to reduce contact wear and thus prolong the life of the contacts.

DRAWINGS

DESCRIPTION OF THE INVENTION

Figure 1:
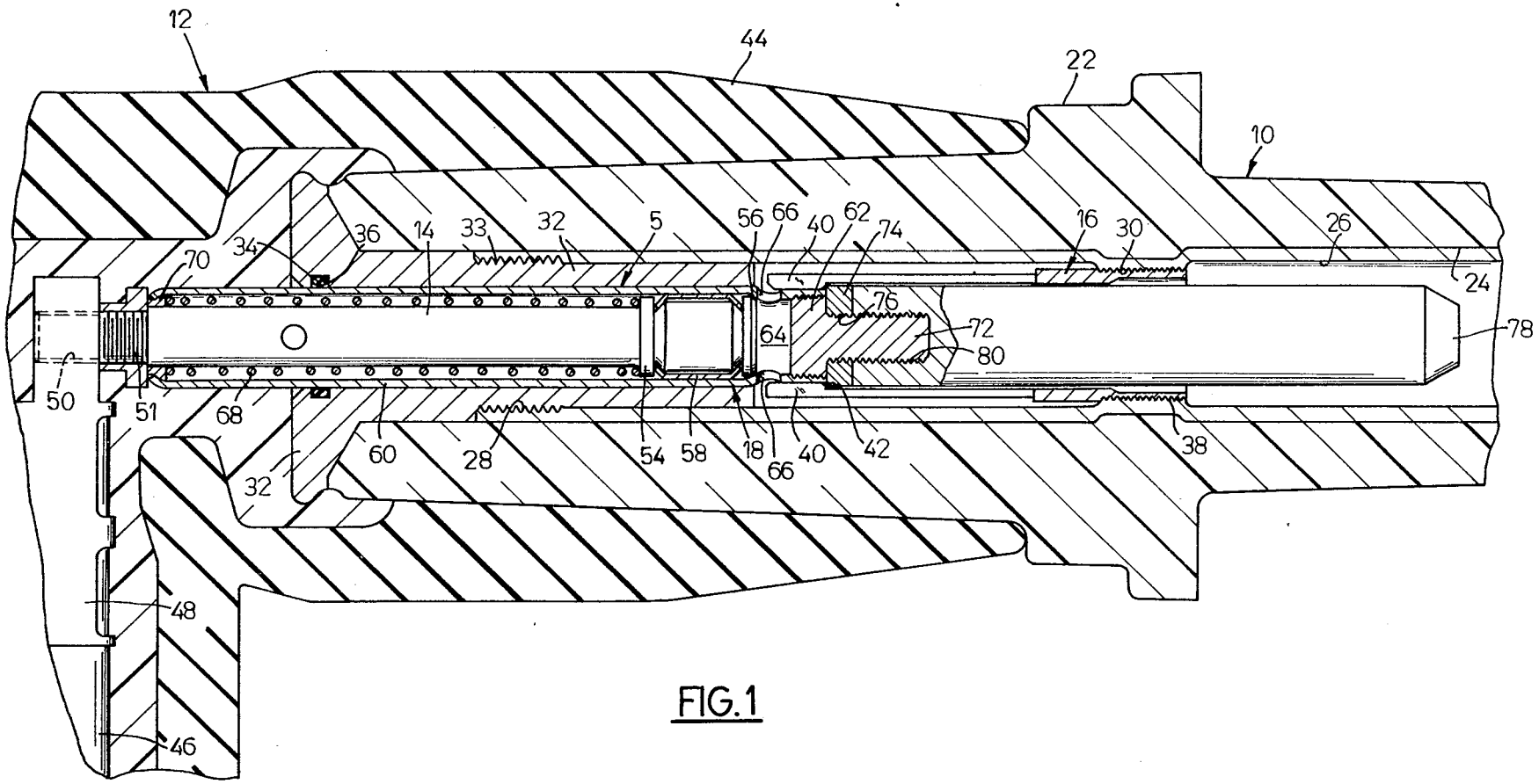
FIG. 1 is a side view in section showing the probe contact assembly for the arc-generated, gas-operated probe.

The quick-make, quick-break probe contact assembly 5 of the present invention is used in an electrical connector assembly of the type which generally includes a high voltage bushing 10 and a high voltage cable terminator 12. The high voltage probe contact assembly 5 is mounted in the terminator 12 and includes a probe contact 14 and meas responsive to an increase in gas pressure for rapidly moving into electrical engagement with a bore contact 16 in the bushing 10. Such means can be in the form of a movable section 18 responsive to a fault current produced increase in arc-extinguishing gas pressure in the bushing 10 (FIGS. 1–6), or in the form of a movable section 20 responsive to a fault current produced increase in the fused section gas pressure in section 20 (FIGS. 7–10).

The bushing 10 generally includes a dielectric housing 22 having a bore 24 and a cylindrical electrically conductive sleeve 26 positioned in the bore 24. The sleeve 26 includes an internal threaded section 28 at one end and a reduced diameter internal threaded section 30 intermediate the ends of the sleeve 26. The sleeve 26 is connected at the inner end of the bushing 10 to an electrical apparatus.

Means are provided at the open end of the sleeve 26 for producing an arc-extinguishing gas on close-in or load break. Such means is in the form of a cylinder 32 formed of an arc extinguishing material and having a threaded portion 33 on the outside surface. The threaded portion 33 on cylinder 32 is secured in the threaded section 28 of sleeve 26. Means can be provided on the inside surface of the cylinder 32 for sealingly engaging the probe contact assembly 5. Such means is in the form of an O-ring seal 34 provided in a groove 36 in the cylinder 32.

The bore contact 16 includes an external threaded section 38 at one end which is threadedly received in the internally threaded section 30 provided in the sleeve 26. The bore contact 16 is slotted to provide a number of resilient contact fingers 40. Each of the fingers 40 is provided with a means for releasably engaging the contact probe assembly 5 in the form of a catch or ledge 42. Means in the form of an O-ring seal can be provided in the bore contact for sealingly engaging the probe contact assembly, if desired.

The terminator 12 conventionally includes an insulating housing 44 which is mounted on a high voltage cable 46. Cable termination is achieved by means of an electrical connector 48 mounted on the cable conductor of a high voltage cable 46 and having a transverse threaded bore 50.

Probe Contact Assembly (FIGS. 1–6)

The probe contact assembly 5 shown in FIGS. 1–6 includes the probe contact 14 which has a threaded end 51 threadedly received in the bore 50 in the cable connector 48. A pair of annular shoulders 54 and 56 are provided at the end of the probe contact 14. Means in the form of an electrical contact ring 58 is mounted on the probe contact 14 between the shoulders 54 and 56.

The movable section 18 mounted on the probe contact 14 for axial movement toward and away from the housing 44. In this regard, the section 18 includes a cylindrical sleeve 60 which is closed at the inner end by means of a cap 62. The sleeve 60 is telescoped onto the probe contact 14 with the cap 62 located in a spaced relation to the end of the probe contact 14 to provide a gas expansion chamber 64. Means are provided in the sleeve 60 for connecting the chamber 64 with the bore of the arc-extinguishing cylinder 32 in the form of a number of ports 66. The sleeve 60 is biased toward or into the housing 44 by means of a spring 68 located on the probe contact 14 between the shoulder 54 and a stop ring 70 crimped in the open end of the sleeve 60. Electrical contact is provided between the inside surface of the sleeve 60 and the probe contact 14 by means of the sliding current contact ring 58.

The cap 62 includes a threaded extension 72. Means are provided on the threaded extension 72 for producing an arc on close-in in the form of an arcing contact ring 74. The ring 74 includes an internally threaded bore 76 and is formed of a material such as tungsten-silver which is highly resistant to erosion due to arcing. An arc-extinguishing member 78 having a threaded recess 80 is threadedly received on the extension 72 of the end cap 62. The member 78 is tubular in form and is moved axially through the bore of the arc-extinguishing cylinder 32 and the fingers 40.

Figure 2:
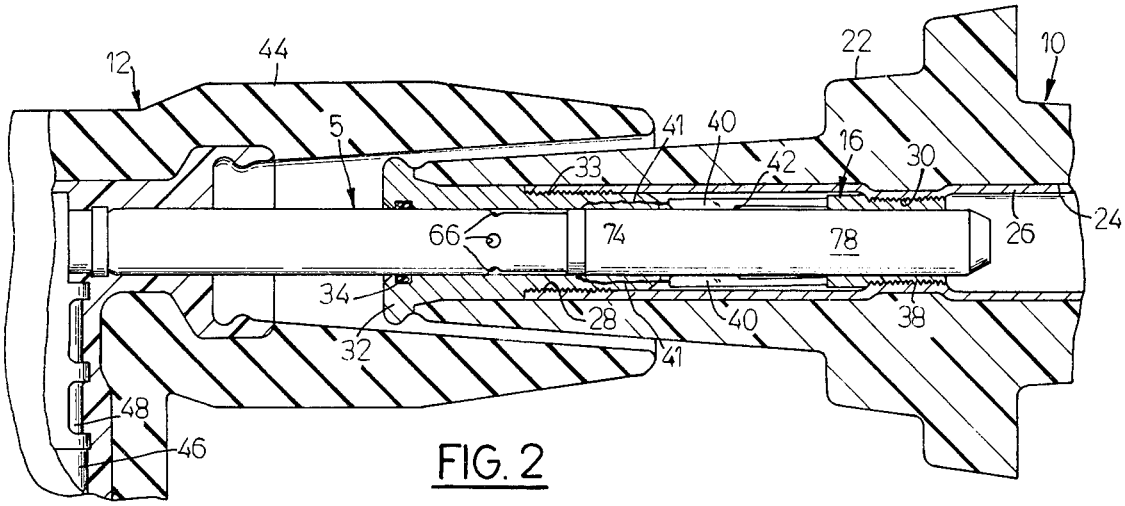
FIG. 2 is a view showing the cable terminator and bushing of FIG. 1 at a position where prestrike occurs.
Figure 3:
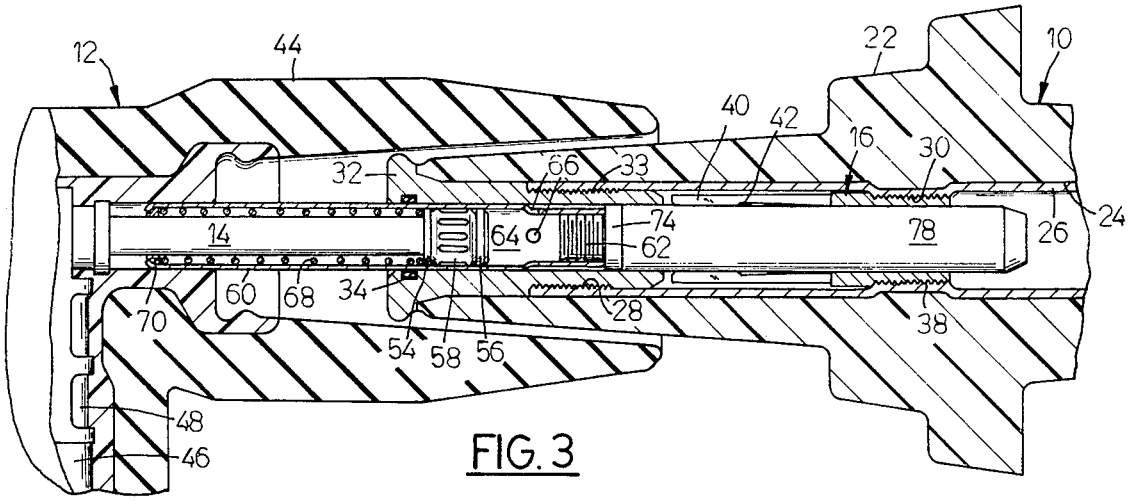
FIG. 3 is a view in section showing the initial movement of the gas operated probe contact assembly after prestrike.
Figure 4:
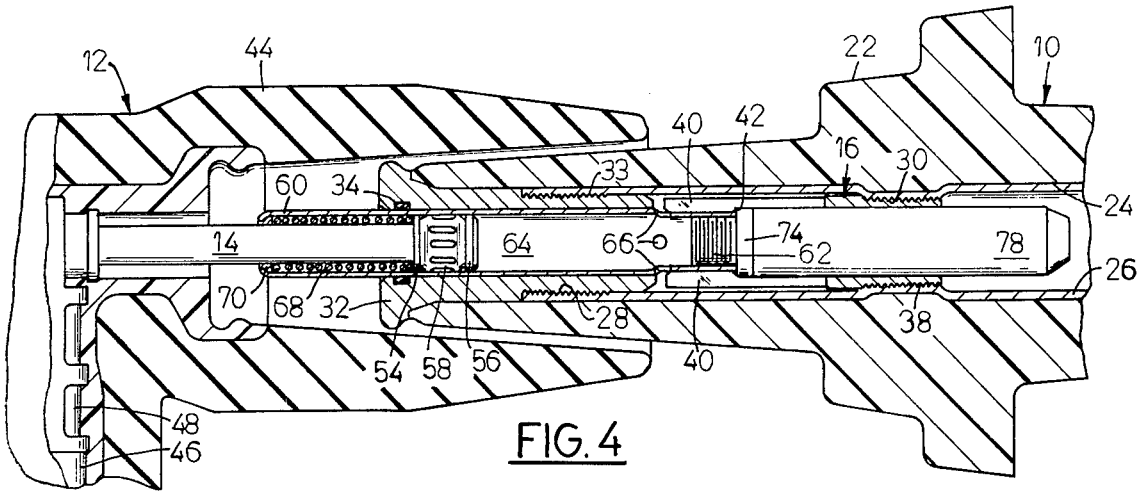
FIG. 4 is a view showing the movable section of the probe contact assembly seated within the bore contact.

When the probe contact assembly 5 is inserted into the bushing 10 (FIGS. 2, 3 and 4), the arc-extinguishing member 78 will pass through the arc-extinguishing cylinder 32 and will cam the resilient fingers 40 on the bore contact 16 outward as the member 78 moves into the bore contact 16. As the arc contact 74 approaches the contact fingers 40 on the bore contact 16, a prestrike arc 41 will occur between the arc contact ring 74 and the contact fingers 40 (FIG. 2). The heat of the arc between the cylinder 32 and the member 78 will produce or generate an arc-extinguishing gas which is confined in the bushing by means of the O-ring seal 34. However, under normal operating conditions, the pressure of the arc generated gas will not rise to a level sufficient to produce any movement of the movable section 18 with respect to the probe contact 14. Once the probe contact assembly 5 has been inserted fully into the bushing, the bore contact fingers 40 will close into engagement with the outer surface of the sleeve 60 with the arc contact ring 74 located behind the shoulder 42 provided on the fingers 40 (FIG. 4).

In the event of a fault current condition existing on close-in, the prestrike arc produced on movement of the arc contact ring 74 toward the fingers 40 of the bore contact 16 will be of such a magnitude that a rapid increase in gas pressure will occur in the cylinder 32. Since the arc-extinguishing gas is confined within the cylinder 32 by means of the seal 34, the gas will flow through the ports 66 into the chamber 64 between the end of the probe contact 14 and the cap 62 (FIG. 3). The build up of gas pressure is very rapid and will force the cap 62 away from the end of the probe contact 14 at a rapid or accelerated rate carrying the sleeve 60, arc contact 74 and arc extinguishing member 78 into the bore contact 16. This rapid acceleration of the movement of the movable section 18 into the bore contact 16 will extinguish the arc by establishing direct electrical communication between the fingers 40 of the bore contact 16 and the outer surface of the sleeve 60.

Figure 5:
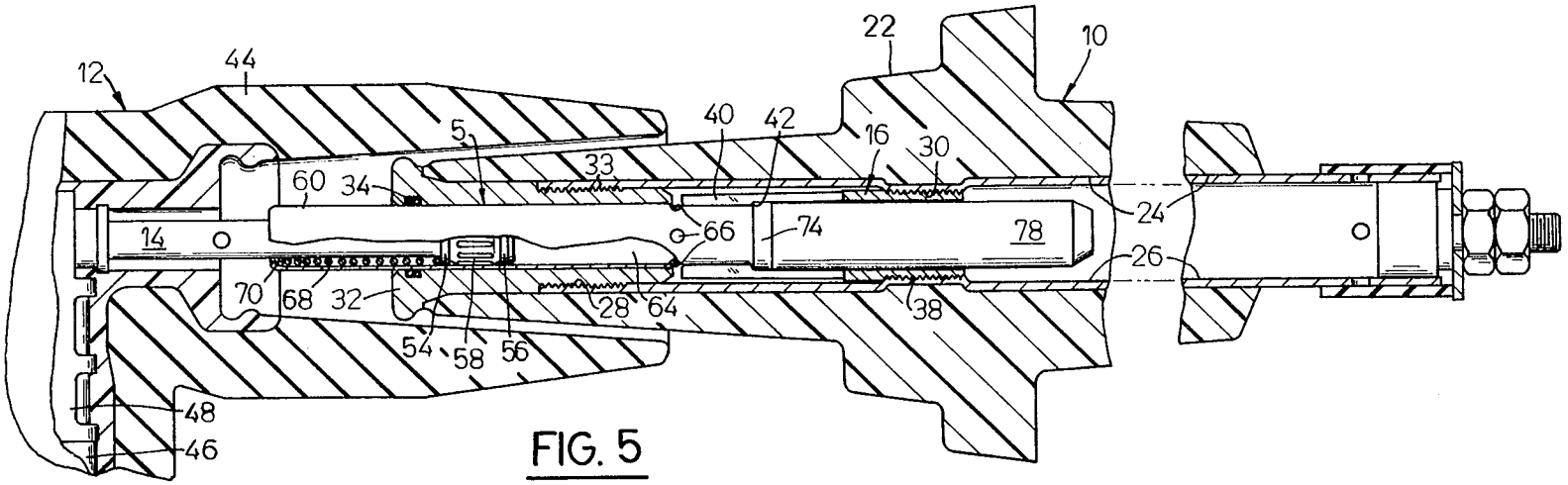
FIG. 5 is a view of the probe contact assembly of FIG. 1 showing the cable terminator pulled away from the bushing on load break.
Figure 6:
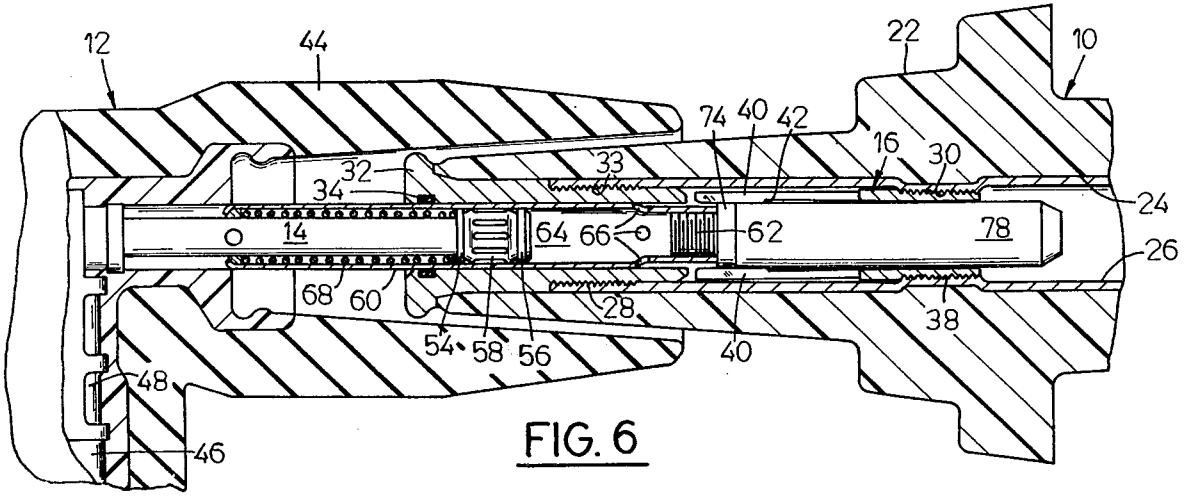
FIG. 6 is a view similar to FIG. 5 showing the movable section on release from the probe contact.

Load Break (FIGS. 5 and 6)

The probe contact assembly 5 in this embodiment of the invention also eliminates or reduces the potential hazard which exists under conditions of load break. This is accomplished by means of the engagement of the arc-contact ring 74 with the shoulders 42 on the bore contact fingers 40. When the terminator 12 is pulled away from the bushing 10 (FIG. 5), the arc contact ring 74 will remain locked behind the shoulders 42 on the fingers 40 holding the movable section 18 in a fixed position. The probe contact 14 will be pulled axially outwardly of the sleeve 60 compressing the spring 68. When the spring 68 has been compressed sufficiently or bottomed between the shoulder 54 and the stop ring 70, any further movement of the terminator 12 will cause the arc contact ring 74 to cam the fingers 40 outwardly. As soon as the arc contact ring 74 clears the shoulders 42, the spring 68 will accelerate the outward movement of the terminator by rapidly telescoping the movable section 18 onto the probe contact 14. This accelerated movement or snap release of the arc contact ring 74 away from the bore contact 16 will elongate the arc occurring on load break at a rate sufficient to extinguish the arc before any hazardous condition exists.

Probe Contact Assembly (FIGS. 7–10

Figure 7:
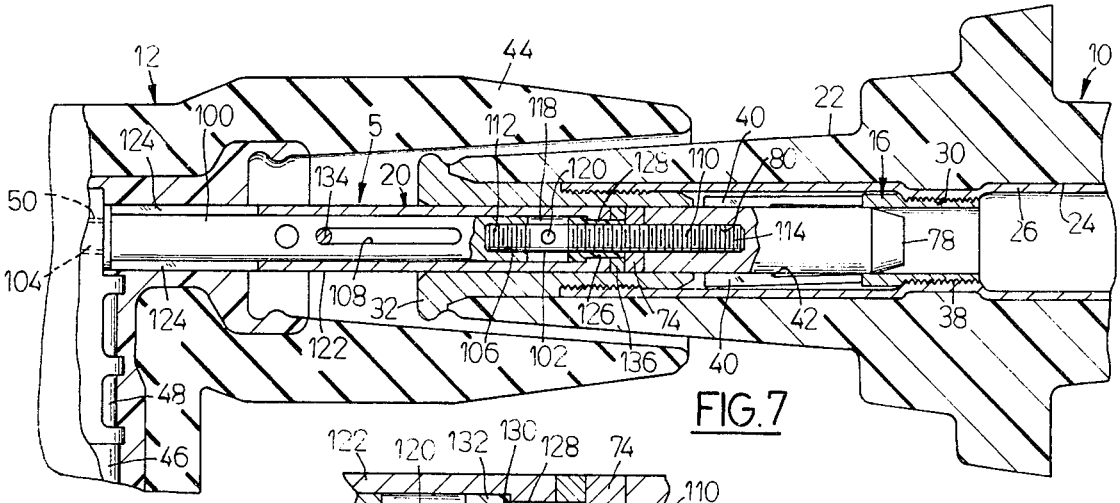
FIG. 7 is a view in section of the probe contact assembly which is responsive to the gas generated on fusing of the probe.
Figure 8:
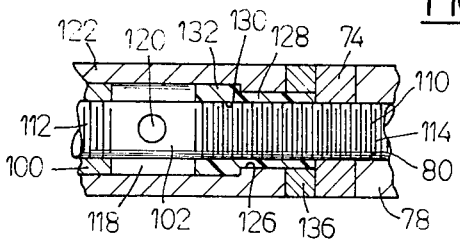
FIG. 8 is an enlarged view of a portion of the fusible member shown in FIG. 7.
Figure 9:
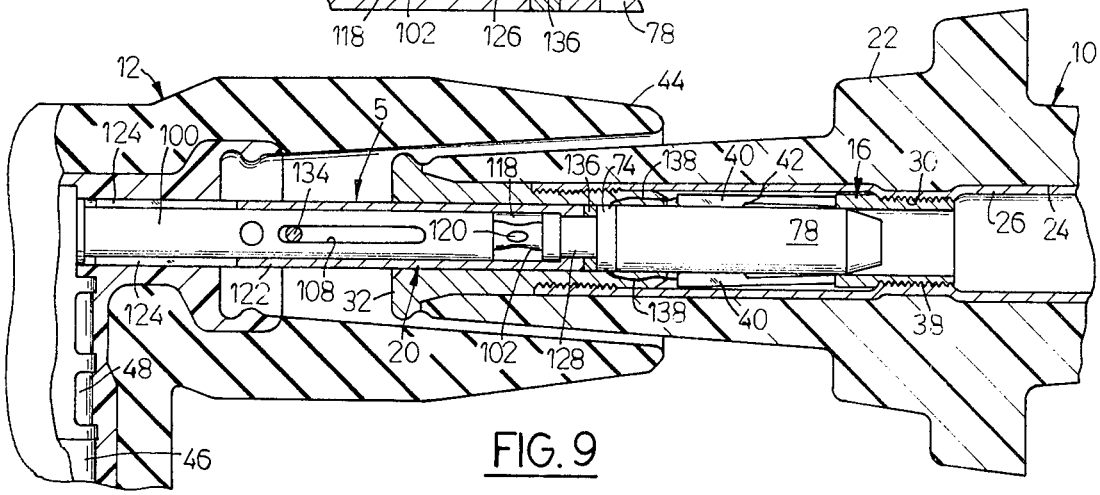
FIG. 9 is a view of the probe contact assembly at the point of prestrike.

The probe contact assembly 5 shown in FIGS. 7–9 is a gas operated type which is field replaceable and capable of one fault use. This probe contact assembly 5 is usable in a bushing 10 in a terminator 12 as described above. Common numbers have been used where the parts are the same.

The terminator 12 in this embodiment is modified to include a probe contact 100 with the movable section 20 telescoped thereon. Under fault current conditions on close-in, the movable section 20 will move rapidly into the bushing 10 due to the generation of a gas produced from a fusible section 102.

More particularly, the probe contact 100 includes a threaded section 104 at one end, a threaded recess 106 at the other end and a slot 108. The contact 100 is threadedly received in the threaded bore 50 of the connector 48 as described above.

The gas pressure required to move the movable section 20 is generated from the fusible section 102 provided in a fusible member 110. In this regard, the fusible member 110 includes a threaded section 112 at one end, a threaded extension 114 at the other end, and the fusible section 102. The fusible member 110 is mounted on the end of the probe contact 100 by screwing the threaded section 112 into the threaded recess 106. The fusible section 102 includes a bore 120 through the center of the section 102.

Gases produced on fusing of the fusible section 102 are confined within a chamber 118 defined by means of a conductive sleeve 122 telescopically mounted on the probe contact 100. The conductive sleeve 122 is slotted at one end to define a number of conductive resilient fingers 124 that are adapted to slide on the surface of the probe contact 100 and includes a reduced diameter section 126 at the other end.

The conductive sleeve 122 is supported on the fusible member 110 by means of a tubular insulating member 128. The member 128 includes a threaded bore 130 and an annular shoulder 132. The member 128 is mounted on the threaded extension 114 of the fusible member 110 with the shoulder 132 in abutting engagement with the fusible section 102. The conductive sleeve 122 is mounted on the insulating member 128 with the reduced diameter section 126 abutting the shoulder 132. The conductive sleeve 122 is limited in axial movement with respect to the probe contact 100 by means of a pin 134 which extends through the slot 108.

Means in the form of an arc contact ring 74 is provided on the member 110 for producing a prestrike arc on close-in. The arc contact ring 74 is located in abutting engagement with the tubular insulating member 128. An insulating ring 136 is provided between the end of the conductive sleeve 122 and the arc contact ring 74. An arc extinguishing tubular member 78 having a threaded recess 80 is threadedly received on the end of the threaded extension 114 of the member 110.

On insertion of the probe contact assembly 5 into the bore contact 16 of the bushing 10, the prestrike arc 138 formed between the arc contact ring 74 and the fingers 40 of the bore contact 16 will establish a current flow path through the fusible member 110 directly into the probe contact 100. Since the current flow under normal conditions is relatively small, it will not produce sufficient heat to fuse the fusible section 102. Once the terminator is completely seated on the bushing 10, the fingers 40 will ride on the surface of the conductive sleeve 122 establishing a current flow path through the conductive sleeve 122 and the fingers 124 into the probe contact 100. Since the arc contact 74 is spaced from the fingers 40, and the fusible member 110 is insulated from the end of the conductive sleeve 122 by the insulating member 128, the fusible section 102 will not be subjected to current flow, it will not fuse even under fault current conditions under normal operations.

Figure 10:
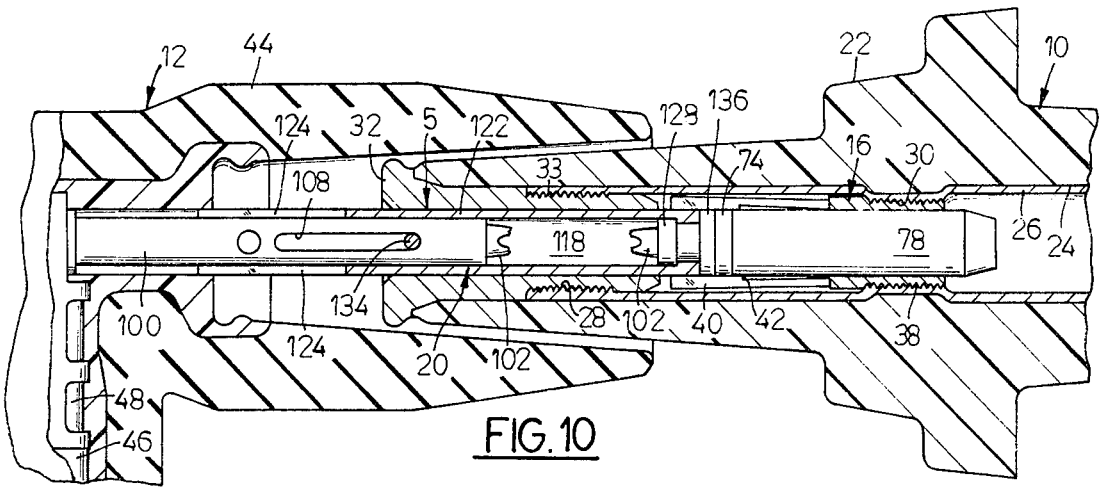
FIG. 10 is a view of the movement of the movable section of the probe contact assembly after fusing of the fusible section.

In the event a fault current condition exists on close-in, a high voltage arc 138 will be formed between the arc contact ring 74 and the bore contact 16 (FIG. 9). The current flow through the arc contact ring and fusible member 110 to the probe contact 100 will be sufficient to fuse the fusible section 102 producing an increase in gas pressure within the conductive sleeve 122. As the gas pressure rapidly increases on fusing of the fusible section 102, the increased gas pressure will rapidly move movable section 20 into the bushing 10 as seen in FIG. 10. In this regard, it should be noted that as the gas expands between the end of the probe contact 100 and the end of the insulating member 128, the close-in motion of the probe contact assembly 5 will be rapidly accelerated by the movement of the movable section 20 onto the bushing. This rapid movement will extinguish the arc by establishing an electrical path directly from the fingers 124 into the probe contact 100. The inward motion of the movable section 120 is limited by the engagement of the pin 134 with the end of the slot 108. Once the fusible section has been fused, the probe contact assembly 5 in this embodiment must be replaced.

FIG. 11

Figure 11:
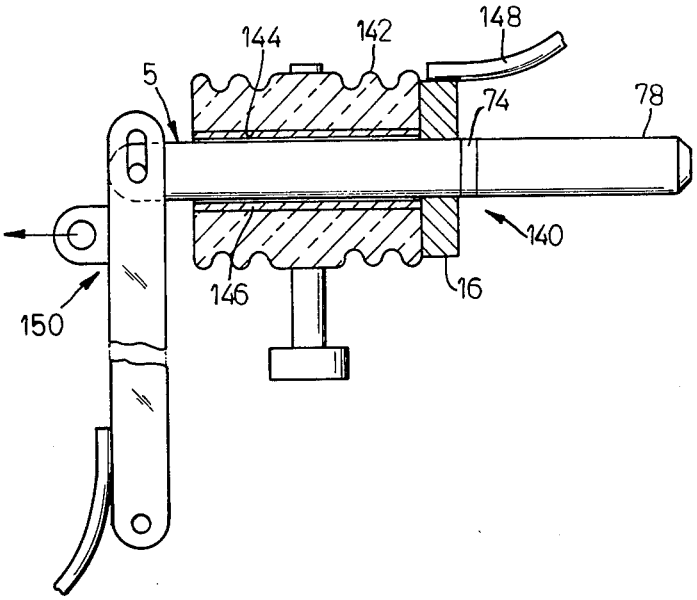
FIG. 11 is a side view partly in section of a quick-make rod and bore contact assembly.

In FIG. 11, a quick-make contact assembly 140 is shown for performing a high voltage switching function. The assembly 140 generally includes an insulating housing 142 having a bore 144, and a cylindrical arc-extinguishing sleeve 146 is positioned in the bore 144. A bore contact 16 is provided at the end of the sleeve 146 and is connected by a line 148 to an electrical device. A probe contact assembly 5 of the type described above and shown in FIGS. 1–6 or 7–10 is used to complete the circuit to the bore contact 16. Any manual or mechanical operator 150 may be used to open and close the switch assembly 140.

The embodiments of the invention in which an exclusive property or privilege is claimed are defined as follows:

1. In a high voltage cable terminator for connecting a high voltage cable to a high voltage bushing, a gas actuated contact probe assembly comprising:

a probe contact and means mounted on said probe contact responsive to an increased pressure produced by a prestrike arc of current for accelerating said probe contact into electrical connection to said bushing on close-in.

2. The assembly according to claim 1 wherein said pressure responsive means includes a sleeve mounted on said probe contact and a gas chamber at the end of said probe contact.

3. The assembly according to claim 2 including a fusible section within said chamber.

4. The assembly according to claim 2 including an arc-extinguishing material located between said probe contact and said bushing on close-in, said sleeve including means for admitting arc generated gas from said arc-extinguishing material into the chamber at the end of the said probe, whereby said sleeve will move rapidly into said bushing.

5. The assembly according to claim 2 including means on said sleeve for releasably engaging said bushing on load break and biasing means for biasing said sleeve away from the bushing on release of said sleeve from the bushing.

6. A probe contact assembly for accelerating the electrical connection of a high voltage cable terminator to a bushing under fault current conditions, said assembly comprising:

a probe contact, a movable electrically conductive section mounted on said probe contact and means responsive to a fault current condition for generating an increasing gas pressure within said movable section to move said section rapidly into electrical connection with the bushing.

7. The assembly according to claim 6 wherein said gas generating means includes a fusible section confined between said contact and said movable section.

8. The assembly according to claim 6 including an arc-extinguishing material associated with said movable section and a chamber defined between said movable section and said probe contact and being in fluid communication with said arc-extinguishing material whereby on increase of gas pressure within said chamber, said section is moved rapidly away from said probe contact.

9. The assembly according to claim 6 including means for biasing said movable section onto said probe, and means on said movable section for releasably for engaging said bushing to increase the force of said bias means on load break whereby on release of said section from said bushing, said section will be moved rapidly onto said probe contact.

10. A quick-make contact assembly comprising, in combination:

an electrically conductive probe contact and an electrically conductive bore contact, said contacts being telescopically movable into engagement, an electrically conductive pressure operated sleeve carried by said probe contact and being responsive to a fault current condition for rapidly connecting said probe contact to said bore contact.

11. The assembly according to claim 10 wherein said pressure operated sleeve includes a fusible member having a fusible section mounted on said probe contact, said sleeve being movable relative to said probe contact on fusing of said fusible section.

12. The assembly according to claim 11 including means for limiting the amount of relative movement of said sleeve with respect to said probe contact.

13. The assembly according to claim 10 wherein said pressure operated sleeve defines a chamber at the end of said probe contact and including means for providing gas pressure communication to the chamber at the end of said probe contact.

14. The assembly according to claim 10 including arc-extinguishing means adjacent the end of one of the probe contact and bore contact and means associated with said bore contact for sealingly engaging said pressure operated sleeve to confine the arc-extinguishing gases to said chamber.

15. A high voltage electrical terminator for connecting a high voltage cable to a bushing having a bore contact herein, said terminator including an insulating housing, an electrical connector positioned in said housing and being adapted to be electrically connected to the high voltage cable, and a probe contact connected to said connector and being telescopically receivable in said bore contact in said bushing, and means carried on said probe contact responsive to a prestrike arc produced increase in pressure in said bushing for accelerating the direct connection of said probe contact to said bore contact.

16. The terminator according to claim 15 wherein said means for connecting said probe contact to said bore contact includes an electrically conductive section mounted on said probe contact and being in electrical communication therewith, said section being movable relative to said probe contact in response to an increase in pressure in said section for rapidly connecting the probe to the bore contact.

17. The terminator according to claim 16 including a fusible member positioned in said section and being connected to said probe whereby the gas pressure produced on fusing of said member will move the said section into electrical connection with the bore contact.

18. The combination of a high voltage busing having a bore contact and an arc-extinguishing cylinder mounted at the entrance to the bore contact, and a high voltage cable terminator for connecting a high voltage cable to the bore contact in the bushing, said terminator including an electrically conductive probe contact telescopically movable into said bore contact, and electrically conductive means mounted on said probe contact responsive to a fault current produced increase in gas pressure for moving said pressure responsive means relative to said probe contact whereby the connection of said probe contact to said bore contact is accerlerated.

19. The combination according to claim 18 wherein said pressure responsive means comprises a sleeve mounted on said probe contact and arc-extinguishing member mounted on the end of said sleeve for telescopic movement through said arc-extinguishing material and said bore contact.

20. The combination according to claim 19 including means in said arc-extinguishing material for sealingly engaging said sleeve to confine the arc-extinguishing gas in the bushing.

21. The combination according to claim 19 including an arcing contact mounted on the end of said sleeve.

22. The combination according to claim 21 wherein said bore contact includes a number of fingers, some of said fingers including a ledge for engaging said arcing contact on close-in, and means for biasing said sleeve onto said probe contact.

23. A probe contact assembly for accelerating the electrical connection of a high voltage cable terminator to a high voltage bushing under fault current conditions, said assembly comprising:

a probe contact, a fusible member mounted on the end of said probe contact and including a fusible section, an insulating cylinder mounted on said fusible member, and an electrically conductive sleeve mounted on said insulating cylinder and being telescopically receivable on said probe contact, said sleeve defining a gas chamber around said fusible section, an arc contact ring mounted on said fusible member for initiating an arc on close-in to provide an electrical current path through said fusible member to said probe contact whereby said fusible section will fuse under fault current conditions producing an increase in gas pressure within said chamber to accelerate the movement of said electrically conductive sleeve into electrical engagement with said bore contact.

24. In a high voltage cable terminator for disconnecting a high voltage cable from a bushing, a snap-release probe contact assembly comprising a probe contact and electrical conductive means biased onto said probe contact for releasably engaging said bushing, whereby on release of said engaging means from said bushing a snap release interruption of the electrical connection of said probe contact to said bushing is provided.

25. A load-break terminator for disconnecting a high voltage cable from a high voltage bushing, said terminator comprising:

an insulating housing adapted to be mounted on a high voltage cable, a connector in said housing electrically connected to said cable, means mounted on said connector for providing electrical communication between said connector and the high voltage bushing, means movably mounted on said electrical communication means for delaying electrical disconnection of said terminator from said bushing, means for biasing said delaying means toward said housing, said delaying means being movable against said biasing means on movement of said housing away from said bushing, said delaying means including means for releasably engaging the bushing whereby releasing of said delaying means from the bushing will accelerate the disconnection of said electrical communication means from said bushing to rapidly extinguish the arc formed on load break.

26. The terminator according to claim 25 including an arc-extinguishing member mounted adjacent said electrical communication means for providing an arc-extinguishing gas on close-in under fault current conditions, said movable means including a chamber in communication with the arc-extinguishing gas whereby said movably mounted means is moved by an increase in gas pressure rapidly into electrical connection with the bushing.

* * * * *